US007552484B2

(12) United States Patent
Seynhaeve et al.

(10) Patent No.: US 7,552,484 B2
(45) Date of Patent: Jun. 30, 2009

(54) SWIMMING GOGGLES

(75) Inventors: Jean Marc Seynhaeve, Hendaye (FR); François Barbier, Hendaye (FR)

(73) Assignee: Decathlon, Villeneuve d'Ascq (FR)

( * ) Notice: Subject to any disclaimer, the term of this patent is extended or adjusted under 35 U.S.C. 154(b) by 0 days.

(21) Appl. No.: 11/491,158

(22) Filed: Jul. 24, 2006

(65) Prior Publication Data

US 2007/0022521 A1 Feb. 1, 2007

(30) Foreign Application Priority Data

Jul. 26, 2005 (FR) ..... 05 07971

(51) Int. Cl.
*A61F 9/02* (2006.01)

(52) U.S. Cl. ..... 2/440; 351/43

(58) Field of Classification Search ..... 2/428, 2/440, 442, 445, 446; 351/43
See application file for complete search history.

(56) References Cited

U.S. PATENT DOCUMENTS 5,857,221 A 1/1999 Geneve et al.
6,694,533 B2 * 2/2004 Chiang ..... 2/428
7,134,148 B2 * 11/2006 Shiue ..... 2/428
2002/0170108 A1 * 11/2002 Chiang ..... 2/442

FOREIGN PATENT DOCUMENTS

EP 1 086 723 A1 3/2001
EP 1 106 214 A1 6/2001
EP 1 262 211 A1 12/2002
EP 1 382 370 A1 1/2004

* cited by examiner

*Primary Examiner*—Katherine Moran
(74) *Attorney, Agent, or Firm*—Kenyon & Kenyon LLP

(57) ABSTRACT

A pair of swimming goggles has two ocular assemblies connected by a bridging element, and the means to adjust their separation. The bridging element is composed, symmetrically in relation to a median plane, of a central body and, laterally on either side of the latter, of a lower stalk and an upper stalk which are flexible and attached to an ocular assembly. Each of the two ocular assemblies has first temporary locking resources, at least on a first face. At least one of the stalks is fitted with second temporary locking resources, designed to fit onto the first temporary locking resources so that the temporary locking of the said stalk on the said first face of the ocular assembly is achieved at a distance from the central body chosen by the user.

15 Claims, 3 Drawing Sheets

SWIMMING GOGGLES

Figure 1:
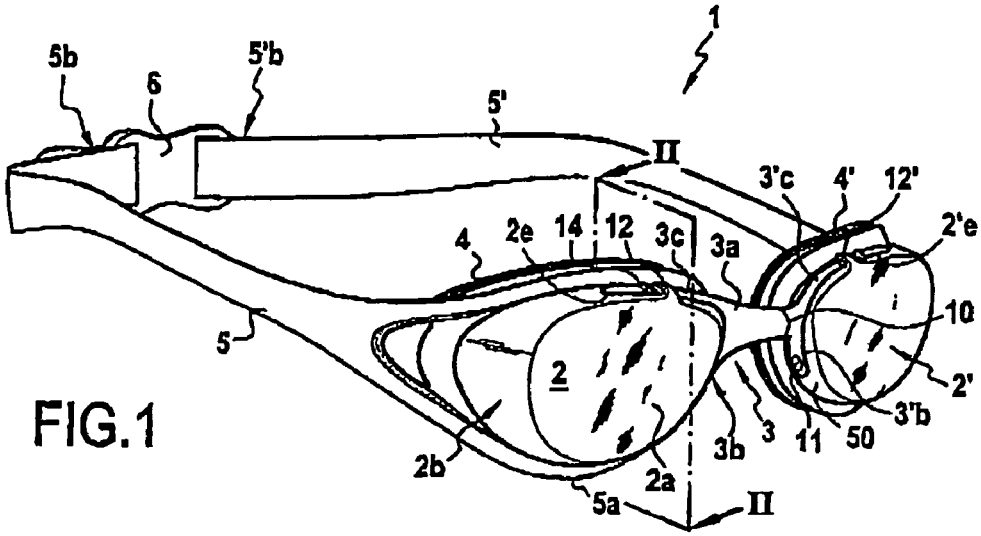

This present invention concerns a pair of goggles which are specially designed for use while swimming for the purpose of preventing the water from coming into contact with the eyes of the swimmer and therefore of allowing the latter to keep his eyes open. In particular, it concerns a pair of swimming goggles that can be adjusted according to the interpupillary distance of the user.

A pair of swimming goggles has two ocular assemblies, one for the right eye and the other for the left eye, resources for connecting these two ocular assemblies together, and resources for securing the ocular assemblies around the head of the user. Generally the securing resources include elastic straps attached to the ocular assemblies, and equipped with attachment resources, preferably that can be adjusted. The elasticity of the straps allows adjustment of the pressure applied by the ocular assemblies around the eyes of the user. The rear part of each ocular assembly, oriented toward the face of the user, is equipped with a compressible element which, because of the pressure applied by the elastic straps, can act as a watertight joint, preventing the water from entering between the ocular element and the part of the face to which this element is applied.

There exist two types of ocular assembly. In the first type, the ocular assembly has a lens, and a lens support in which the lens is mounted in a watertight manner. In the second type, the part acting as the lens is composed by the front surface of the lens support.

The primary function performed by a pair of swimming goggles is not to correct any vision problems of the user, as in the case of conventional spectacles, but to prevent contact between the water and the eyes during use while swimming. It is therefore necessary, so that this function is performed perfectly, that there is a perfect seal at each ocular assembly, whatever the shape of the face of the user, and in particular whatever the interpupillary distance.

In order to take account of the variations that exist from one individual to the next in terms of interpupillary distance, goggles have already been proposed that are equipped with resources for adjusting the separation between the two ocular assemblies.

Certain adjusting resources can be mounted directly on the bridging element, or the nose-bridge element as it is sometimes called, but in this case it is necessary that the bridging element should be sufficiently long to allow manipulation of the adjusting system, so that this system frequently causes pressure on the sides of the nose, resulting in annoyance and discomfort for the wearer.

In document EP.1.800.369, there are two cords which perform the functions both of resources for the connection and adjustment of the two ocular assemblies and for securing around the head of the user. Each ocular assembly has two junction elements positioned diametrically opposite, and the two cords each pass in the two junction elements of the two ocular assemblies, with the first cord located on the upper face of each ocular assembly while the second is located on the lower face. The part of the two superimposed cords that lies between the two inside junction elements comprise the bridging element between the two ocular assemblies, also known as the bridge. Adjustment of the separation between the two ocular assemblies is achieved by sliding the two ocular assemblies along the two cords.

In document EP.1.382.370, the bridging element which connects the two left and right lens supports includes a central part whose bottom edge touches the nose of the user and, on either side of this central part, a guidance part composed of more or less parallel first and second rods. These guidance rods pass through holes created in connection elements which are positioned on the upper and lower faces of the lens supports. Thus, in order to adjust the separation between the two ocular assemblies, it suffices, according to this previous document, to slide each ocular assembly a certain distance along the parallel guidance adjustment rods. In this document, the securing resources are connected to the ends of the two guidance rods.

The swimming goggles known from the above documents, with separation adjustment of the ocular assemblies, have certain drawbacks. For the goggles of document EP.1.800.369, it is not really easy to achieve the simultaneous sliding of the two cords constituting the bridging element on the upper and lower faces of each ocular assembly. Moreover, since it is these two same cords which are used to secure the goggles around the head of the user, then the extension of the free ends of the two cords can also affect the portion of the two cords acting as the bridging element, with maladjustment of the separation between the two ocular assemblies.

For the goggles of document EP.1.382.370, given that adjustment of the separation is achieved by simple sliding of the two ocular assemblies along the parallel guidance rods, there is a high risk of maladjusting this separation after an impact or even merely during handling of these goggles as they are transported. The manufacture of this pair of swimming goggles proves to be relatively complex, in particular concerning the main part on which the two ocular assemblies have to slide, which necessarily has to be in a sufficiently rigid material so that the two guidance rods remain more or less parallel to each other.

The objective set by the applicant is therefore to propose a pair of swimming goggles which overcomes the aforementioned drawbacks.

The first objective of this present invention is therefore to propose a pair of swimming goggles whose system for adjusting the separation between the two ocular assemblies represents an operation that is easy for the user.

A second objective is to propose a pair of swimming goggles of simplified design and manufacture.

In a manner which is already known, the pair of swimming goggles of this present invention has two ocular assemblies connected by a bridging element, and the means to adjust the separation between the said two ocular assemblies.

Characteristically:

the bridging element is composed, symmetrically to a plane AA', of a central body and, laterally on either side of the latter, of a lower stalk and an upper stalk which are flexible and attached to an ocular assembly, each of the two ocular assemblies has, at least on a first face, a shoulder acting as first temporary locking resources, of a given stalk, the said stalk is fitted with ridges or holes, acting as second temporary locking resources, designed to fit onto the shoulder so that the temporary locking of the said stalk on the said first face of the ocular assembly is achieved at a distance from the central body chosen by the user.

In this present text, when there is a question of an action relating to a given stalk, whether lower or upper, it is necessary to consider that this is applied to both corresponding stalks, left and right.

Thus, according to the particular arrangement of this present invention, adjustment of the separation between the two ocular assemblies, which is a function of the interpupillary distance of the user, is effected only at the upper and/or lower stalk, by varying the distance between the temporary locking point(s) or zone(s) of the said stalk(s) with the ocular assembly and the central body of the bridging element. The locking is said to be temporary because it allows adjustment of the separation by the user The ocular assembly generally has a front surface, perpendicular to the median plane AA', which is extended to the rear by a lateral face which forms an open chamber with the front surface. The shoulder is placed preferably on the lateral face, more precisely on the upper portion of the said lateral face and/or on the proximal portion of the said lateral face, meaning the portion of the lateral face which is closest to the median plane AA'.

In one implementation method, only one of the two stalks, upper or lower, is fitted with ridges or holes, acting as second temporary locking resources.

In this variant, the other stalk, not fitted with ridges or holes, has its end fixed definitively to the first face of the ocular assembly which has no shoulder. Adjustment of the separation between the two ocular assemblies takes the form of a variation in the length of the corresponding stalk, where such variation causes a slight angular displacement of the ocular assembly in relation to the central body. This angular displacement is not redhibitory since it is compensated, due to the flexibility of the upper and lower stalks, by the traction forces to which the bridging element is subjected during the fitting of the swimming goggles onto the head of the user, in particular the traction force caused by the extension of the elastic straps.

On the other hand, in order to absorb this angular deformation, it can be arranged that the central body is created from a flexible material having a deformation characteristic of the elastomer type.

This phenomenon of angular displacement of the ocular assembly does not appear, or appears to a lesser extent, when adjusting the separation between the two ocular assemblies is achieved by the implementation of two sets of first and second temporary locking resources, respectively equipping firstly the two upper and lower stalks of the bridging element and secondly the two first faces of the ocular assemblies, in particular the upper and proximal portions of the lateral faces of the said ocular assemblies.

In another implementation variant, the shoulder, acting as the temporary locking element, is a longitudinal shoulder drilled with a hole for the passage of the, preferably upper, stalk and formed on a first, preferably upper, face of the ocular assembly, and the second temporary locking resources are composed of a multiplicity of successive ridges formed on the said stalk and designed to constitute that many end stops against the outer face of the longitudinal shoulder. In this variant, the material employed either for the shoulder or for the stalk is deformable so that it is possible, by applying traction or pressure to the said stalk, to pass a ridge through the hole created in the shoulder. The user then only has to apply this traction or this pressure until selection of the ridge forming an end-stop against the outer face of the shoulder, which corresponds to the wanted distance of the stalk between the shoulder, acting as the locking point, and the central body.

In an implementation variant, the shoulder acting as the first temporary locking resources takes the form of a stud in the shape of a mushroom, formed on a first face of the ocular assembly. In this case, the second temporary locking resources are composed of a multiplicity of successive open holes formed in the upper or lower stalk, equipped with the said second temporary locking resources. During adjustment of the separation, it suffices for the user to select the open hole corresponding to the desired adjustment and to press the stud into it. Where appropriate, the open holes can be connected to each other by a narrow slot so that the selection of the open hole is achieved by pulling on the stalk while the latter is still in position on the stud.

When there is only a single set of first and second temporary locking resources, the definitive securing of the end of the stalk devoid of second temporary locking resources on the first face of the ocular assembly can also be accomplished in the same way by using a stud in the shape of a mushroom formed on the said first face and a single open hole formed on the end of the stalk. There is therefore no possibility of selection but rather a securing operation which is said to be definitive, since it does not allow adjustment of the separation. However this securing method greatly facilitates the assembly operations of the bridging element onto the ocular assemblies during the manufacture of the lens.

Preferably, according to these last variants, the ocular assembly and the shoulder acting as the first temporary locking resource formed on a first face and either the shoulder or the securing resources formed on the other first face, are made as a single part.

In another implementation variant, the central body and, laterally, the two sets of upper and lower stalks, are also a single part.

In a preferred implementation variant, of particularly simplified manufacture, the swimming goggles of this present invention are composed of a total of eight separate parts namely:

two single-block ocular assemblies, a single-block bridging element, two watertight pressure-parts, in compressible material, mounted on the periphery of the rear faces of the two ocular assemblies, two elastic straps, each with one free end in the form of a loop, shaped to be mounted around an ocular assembly between, firstly, the shoulder acting as the first temporary locking resources and where appropriate the securing resources of the upper and lower stalks and, secondly, the watertight pressure-part and a buckle for the attachment of the other two free ends of the two elastic straps.

Figure 2:
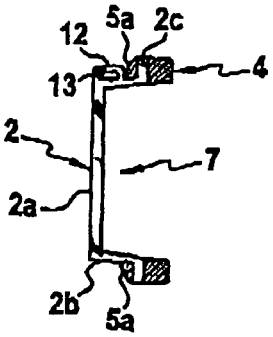
Figure 6:
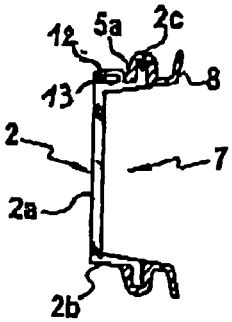
Figure 3:
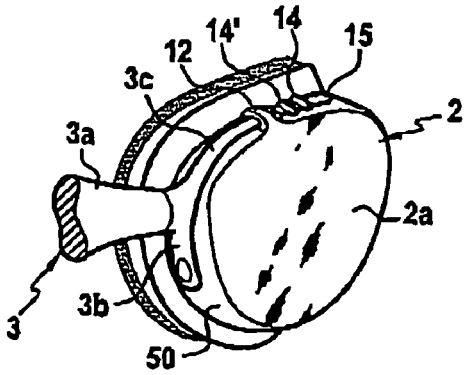
Figure 4:
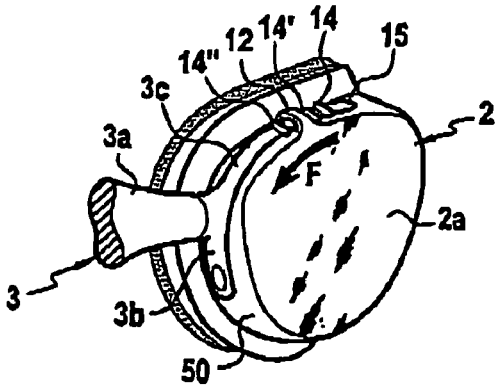
Figure 5:
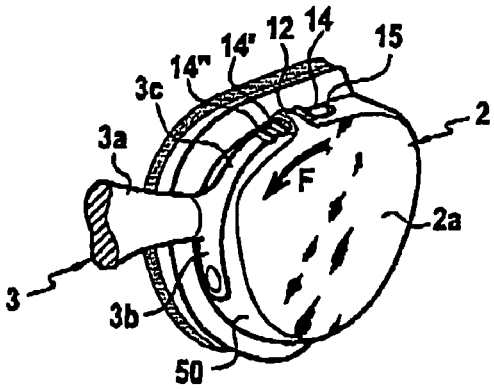
Figure 7:
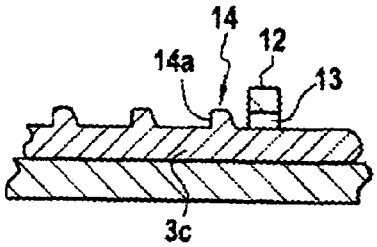
Figure 7:
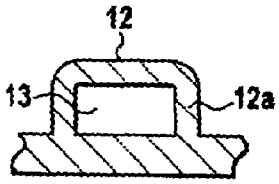
Figure 14:
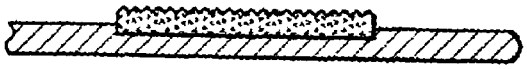
Figure 15:
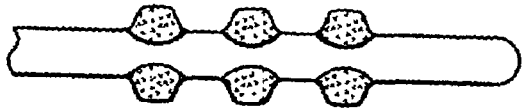
Figure 16:
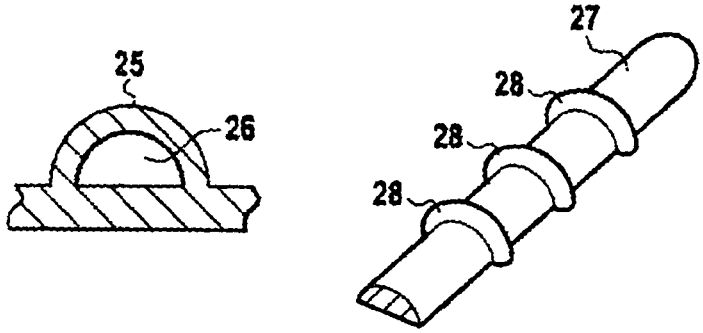
Figure 17:
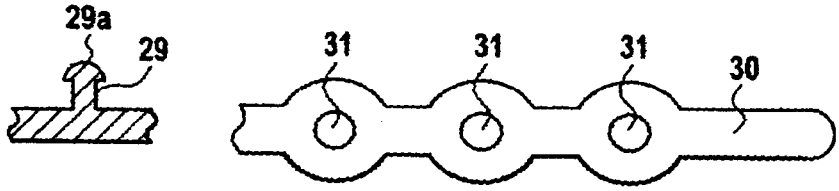
Figure 18:
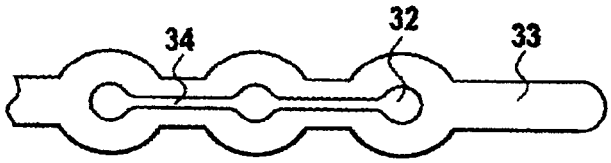
Figure 19:
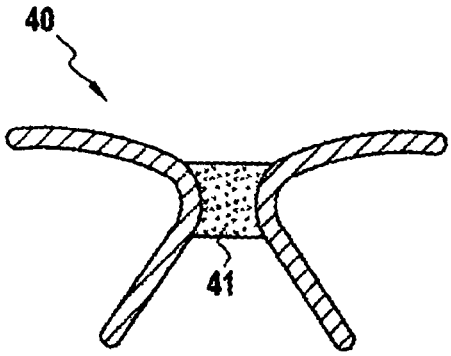
Figure 20:
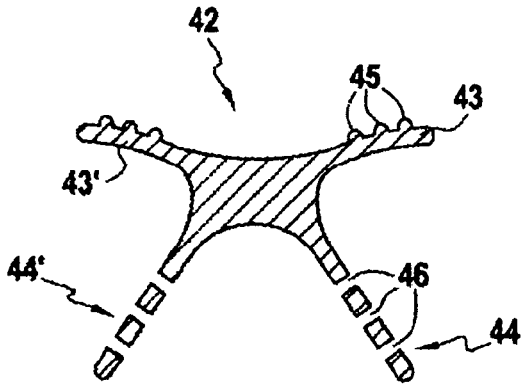

This present invention will be better understood on reading the following description of implementation examples of a pair of swimming goggles, with a capacity for adjustment according to the interpupillary distance of the user, with reference to the appended figures, in which:

FIG. 1 is a view in perspective of an implementation example of a pair of swimming goggles composed of eight separate parts, FIG. 2 is a schematic view in cross section of the pair of goggles of FIG. 1 in plane II-II, FIGS. 3, 4 and 5 illustrate three adjustment positions of the separation between the two ocular assemblies of the pair of goggles of FIG. 1 and FIG. 6 is a schematic representation in cross section similar to FIG. 2, but showing another implementation example, FIGS. 7 to 15 illustrate different types of ridges with which an upper stalk can be equipped for the purpose of fitting onto a shoulder of the arched type formed on the upper face of an ocular assembly, where the said arch has a hole created in a more or less rectangular shape, FIG. 16 illustrates another implementation method in which the shoulder takes the form of an arch whose hole is configured more or less in the shape of a semicircle, FIGS. 17 and 18 illustrate two methods of implementation of temporary locking resources of an upper stalk with a lug in the form of a pin formed on the upper face of an ocular assembly, FIG. 19 is a schematic front view of a bridging element whose central body is in a material that deforms elastomerically and FIG. 20 is a schematic representation of a bridging element whose upper and lower stalks are equipped with second temporary locking resources of different construction.

The pair of swimming goggles (1) which is illustrated in FIG. 1 is specially designed for use while swimming, or more generally for sport or leisure, where the aim is to protect the eyes against any contact with the water. This pair of goggles is equipped with an adjusting system which takes account of the interpupillary distance of the user.

In the preferred version illustrated in FIG. 1, this pair of goggles (1) is composed of a total of eight separate parts, namely two ocular assemblies (2, 2'), a bridging element (3), two watertight pressure-parts (4, 4'), two elastic straps (5, 5') and an attachment buckle (6).

Each of the two ocular assemblies (2, 2') is a single-block part, in a hard or transparent plastic material, whose front surface (2*a*) acts as a lens, in like manner to the correction lenses of a pair of conventional goggles. This front surface (2*a*) is extended to the rear by a lateral face (2*b*) which, together with the front surface (2*a*), forms an inner chamber (7) which is totally open at the rear of the ocular assembly (2). In the example illustrated, the lateral face (2*b*) is extended by a lip (2*c*) projecting to the exterior, with this lip allowing the securing of a watertight pressure-part (4).

In the example illustrated in FIGS. 1 and 2, this sealing part (4) is composed of an elastomer-type foam which is affixed to the rear face of the lip (2*c*). In the implementation example illustrated in FIG. 6, the sealing part (8) is a part of the rubber-gasket or elastomer or silicone type, which is designed to be locked onto the lip (2*c*).

Whatever the type of sealing part, the latter is designed to be pressed onto the face of the user and to act as the watertight element of the corresponding ocular assembly (2), preventing the water from entering into the inner chamber (7).

The bridging element (3) is a single-block part, created by moulding from a semi-rigid plastic material which nevertheless has a certain flexibility in terms of its thickness. This bridging element (3) is symmetrical in relation to the median vertical plane (AA') of the pair of goggles. It has a central body (3*a*) and, on either side of the latter, symmetrically to plane AA', a lower stalk (3*b*) and an upper stalk (3*c*) both of which exhibit a certain flexibility in relation to the central body (3*a*).

The central body (3*a*) may not be flat between the two sets of lateral stalks, but can take the form of a hump extending outside of the plane formed by the front faces (2*a*) of the two ocular assemblies (2). This hump appears mainly in FIG. 1, because of the representation of the line (10) which symbolises the upper edge of this hump passing through the median plane (AA').

The bridging element (3), sometimes called the nose-bridge, connects the two ocular assemblies (2, 2') by means of the two sets of lower (3*b*, 3*b'*) and upper (3*c*, 3*c'*) stalks.

In the implementation example illustrated in FIG. 19, the bridging element (40) is not a single-block part, with the central body (41) being created in a flexible material, with elastomer-type deformation, in contrast to that in which upper and lower stalks are formed.

In the implementation example illustrated more particularly in FIGS. 1, 3, 4 and 5, each lower stalk (3*b*, 3*b'*) is fixed, definitively, on the lateral face (2*b*) of the corresponding ocular assembly (2, 2'). More precisely this securing action concerns the proximal portion (50) of the said lateral face (2'b), meaning that which is oriented toward the other ocular assembly (2) and which is therefore closest to the median plane (AA'). This securing is said to be definitive to the extent that it is not equipped with the capability of adjustment by the user, with this securing action performed during the assembly of the pair of goggles (1). This securing can be effected by means of any appropriate resource. By way of an example, when it is moulded, the ocular assembly (2) has, on this proximal portion (50), a stud (11) in the shape of a mushroom, terminated by a prominent head, and the end of the lower stalk (3'*b*) is drilled with an open hole. In this example, securing is effected by pushing the head of the stud (11) into the hole on the end of the lower stalk (3'*b*). The presence of the prominent head, preferably oriented in the shape of hook, prevents the lower stalk (3'*b*) from freeing itself from the ocular assembly (2)' by escaping from the stud (11).

The securing of the upper stalk (3*c*) on the ocular assembly (2) is a temporary operation, allowing the adjustment by the user of the separation between the two ocular assemblies (2, 2') to suit the interpupillary distance. This temporary securing is effected using the first and second temporary locking resources which are mounted respectively on the upper portion (2*e*) of the lateral face (2*b*) of the ocular assembly (2) for the first, and on the end of the upper stalk (3*c*) for the second.

In the example illustrated, the first temporary locking resources are composed of a longitudinal shoulder (12), drilled with a hole (13). This longitudinal shoulder is created during the moulding of the single-block ocular assembly (2) in the example illustrated.

The second temporary locking resources are composed of a succession of ridges (14) formed on the end of the upper stalk (3*c*). The configuration of the hole (13) in the longitudinal shoulder (12), and that of the ridges (14), are determined so that the upper stalk (3*c*) can pass freely through the hole (13) where it has no ridge, and that passage of the stalk where there is a ridge is possible only by applying sufficient traction or pressure to the said upper stalk (3*c*) in order to achieve deformation of the ridge, allowing it to pass. Once the ridge has passed, the internal face of the latter comprises a stop point which prevents the upper stalk (3*c*) from coming out of the shoulder (12) during normal use of the pair of goggles (1). The many ridges (14) allow the user to determine the position at which the upper stalk (3*c*) will be secured at the longitudinal shoulder (12). the distance between the ocular assembly (2) and the median plane (AA') passing through the median axis (10) of the central body (3*a*) can thus be adjusted by the user.

Given that—in this implementation method—the securing of the lower stalk (3*b*) is definitive, one observes, when one changes the ridge (14) which acts as a stop point to the shoulder (12), a certain angular displacement of the ocular assembly in relation to the central body (3*a*). This angular displacement is not a drawback however, to the extent that because of the flexibility of the two sets of stalks (3*b*, 3*b'*, 3*c*, 3*c'*), and where appropriate the deformability of the central body, the ocular assemblies (2, 2') find their place quite naturally pressing onto the face of the user under the effect of the traction of the elastic straps which are used to secure the pair of goggles (1) around the head of the user.

In the example illustrated in FIG. 1, each of the two elastic straps (5, 5'), in silicone, rubber, or synthetic natural elastomer, has a first end (5*a*) in the form of a loop, which is shaped to be mounted on the rim of an ocular assembly (2), pressing more or less flat against the lateral face (2*b*) and the outer face of the lip (2*c*), and passant in particular between the longitudinal shoulder (12) and the said lip (2*c*) and likewise between the stud (11) and the said lip (2*c*) Where appropriate, as illustrated in FIG. 2, the lateral face (2*b*), in the zone adjacent to the lip (2*c*) has a groove into which the end (5*a*) of the strap (5) can fit. The securing of this end (5*a*) can be completed by glueing.

The attachment of the two other free ends (5*b* and 5'b) of the two elastic straps (5, 5') is achieved by using an attachment buckle (6), with the means to adjust the length of each strap (5) passing into the said buckle (6), using ridges formed on the outer face of the free end (5*b*) for example.

In the implementation example illustrated in FIG. 6, the watertight pressure-part (8), in a compressible material, mounted on the periphery of the rear face of the ocular assembly (2), is incorporated into the end (5*a*) in the form of a loop in the elastic strap (5). Thus, in this implementation method, there are therefore no longer eight separate parts, but only six.

FIGS. 3 to 5 illustrate the three positions that can be adopted by an ocular assembly (2) in relation to the median axis (10) of the central body (3*a*) of the bridging element (3) when, according to this implementation example, the upper stalk (3*c*) has three levels of adjustment composed of a succession of three ridges (14, 14', 14"), with this numbering beginning from the free end (15) of the upper stalk (3*c*).

According to the first position, illustrated in FIG. 3, the longitudinal shoulder (12) is butted up against the internal face of the third ridge (14"). This positioning corresponds to adjustment of the smallest separation between the two ocular assemblies (2, 2').

According to the second position, illustrated in FIG. 4, the upper stalk (3*c*) has been moved in the direction of the arrow (F), and the longitudinal shoulder (12) is positioned between the third ridge (14") and the second ridge (14'), and in particular is butted up against the internal face of this second ridge (14'). This position corresponds to intermediate adjustment of the separation between the two ocular assemblies (2, 2').

According to the third position, illustrated in FIG. 5, the upper stalk (3*c*) has again been moved in the direction of the arrow (F), and the longitudinal shoulder (12) is positioned between the second ridge (14') and the first ridge (14), being in particular butted up against the internal face of the said first ridge (14). This position corresponds to the maximum adjustment of the separation between the two ocular assemblies (2, 2').

It should be noted that in the first position, illustrated in FIG. 3, the lower (3*b*) and upper (3*c*) stalks up to the transverse shoulder (12) are more or less pressing onto the lateral face (2*b*) of the ocular element (2). However in the intermediate position of FIG. 4 and the extreme position of FIG. 5, an empty space forms between the lateral face (2*b*) and the lower (3*b*) and upper (3*c*) stalks, this space representing the distancing of the two ocular assemblies (2, 2').

FIGS. 7 to 18 illustrate implementation variants concerning the first and the second temporary locking resources mounted respectively on a first face of the ocular assembly (2) and on one of the upper or lower stalks. FIG. 7 again uses the implementation method which has been described above concerning the longitudinal shoulder (12), in the form of an arch, whose aperture (13) has a section which is more or less rectangular. The end of the stalk, the upper (3*c*) for example, has ridges (14) which are asymmetrical, with an internal face (14*a*) that is more or less perpendicular to the plane of the upper face of the said stalk. It is this internal face (14*a*) which is intended to butt up against the longitudinal shoulder (12).

The methods of implementation illustrated in FIGS. 8 to 15 differ from that just described only by the configuration of the ridges, with the longitudinal shoulder (12) keeping the same configuration.

Figure 8:
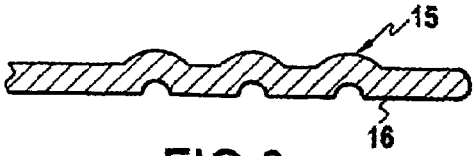

In the example of FIG. 8, in a view in section, each ridge corresponds to a hump (15) which is formed throughout the thickness of the end of the stalk.

Figure 9:
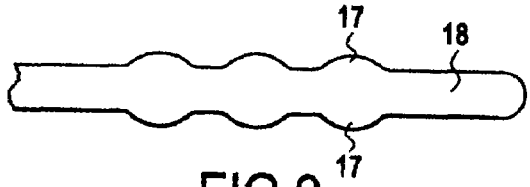

In the example of FIG. 9, in a top view, each ridge (17) corresponds to a lateral excrescence formed on either side of the end of the stalk (18). In this implementation method, the excrescences (17) press onto the lateral uprights (12*a*) of the longitudinal shoulder (12) (see also FIG. 7).

Figure 10:
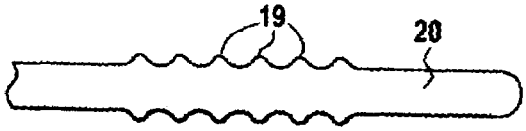
Figure 11:
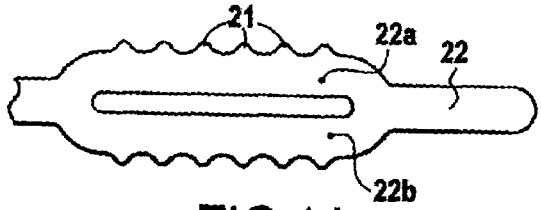

In the example of FIG. 10, in a top view, there is a close succession of small excrescences (19) formed on the end of the stalk (20). In this implementation method, there are no totally predetermined adjustment positions but rather possible positioning zones all along the length equipped with the small excrescences (19).

In the example of FIG. 11, in a top view, we again see these same small excrescences (21) but over the length in which these excrescences (21) are located, there is a splitting of the stalk (22) into two branches (22*a*, 22*b*). This particular arrangement allows a certain compression capacity of the said stalk (22) to be achieved during its passage in the aperture (13) of the longitudinal shoulder.

Figure 12:
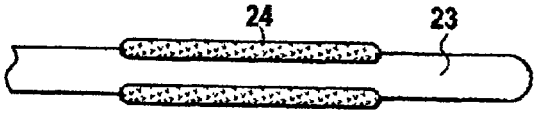

In the example of FIG. 12, in a top view, the second temporary locking resource supported by the end of the stalk (23) is not composed of a multiplicity of ridges but rather by the addition of two lateral strips of an external covering in a material which has higher adhesion quality that the material employed for the stalk (23) proper. When the user has moved the stalk (23) at the longitudinal shoulder, in order to effect the desired adjustment of the separation between the two ocular assemblies, the adhesion between the covering on the lateral strips (24) and the lateral uprights (12*a*) of the longitudinal shoulder (12) is such that there is no longer any movement in relation to the upper stalk (23) and to the shoulder during normal use of the pair of goggles.

Figure 13:
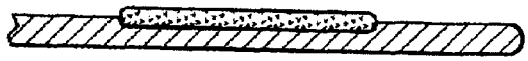

The implementation example illustrated in FIG. 13, in a view in section, differs from that of FIG. 12 by the fact that the external surface, having a higher adhesion quality than the material employed for the stalk, is a strip formed on top of the stalk.

FIG. 14, in a view in section, illustrates a variant of the implementation method of FIG. 13, having a surface with a close succession of small excrescences.

In the implementation example illustrated in FIG. 15, in a top view, the addition of an external covering in a material with a higher adhesion quality than the material employed for the stalk proper, takes the form of lateral ridges.

In the implementation example illustrated in FIG. 16, the longitudinal shoulder (25) and its aperture (26) are configured in a circular arc, and likewise the end of the stalk (27) has a cross section in a circular arc, as have the ridges (28) which project from the outside of the said stalk (27).

The two implementation examples of FIGS. 17 and 18 illustrate another type of temporary locking resource. In these two methods of implementation, there is no longer any longitudinal shoulder drilled with an aperture, but only a stud (29), formed on a first face of the ocular assembly. This stud (29), has a mushroom shape, with a prominent head (29*a*). The end of the stalk (30) is drilled with a succession of open holes (31). If the width of the stalk (30) at the open holes (31) is not sufficient, this width is preferably increased in the zones where the said open holes (31) are located, as illustrated in FIG. 17.

The implementation example illustrated in FIG. 18 differs from that of FIG. 17 by the fact that the open holes (32) formed in the end of the upper stalk (33) are connected together by slots (34), which allows adjustment of the separation between the ocular assemblies by movement from one open hole to the next, passing through a slot (34), without the need to remove the stalk (33) from the stud (29), as is the case with the implementation method of figure (17).

It is this same implementation method, with a stud in the shape of a mushroom, which can be employed for the definitive securing of one of the stalks. In this case the end of the said stalk is fitted with a single open hole and the prominent head of the stud is preferably extended in the form of a hook, so as to render still more difficult the extraction of the end of the stalk from the said stud.

FIG. 20 is a very schematic representation of a bridging element (42) whose upper stalks (43, 43') and lower stalks (44, 44') include second temporary locking resources of a different construction. In this illustrated example, the second temporary locking resources of the upper stalks (43, 43') are formed of ridges (45), while the second temporary locking resources of the lower stalks (44, 44') are composed of open holes (46). Naturally, this is just one of many possible examples, and the second temporary locking resources can be of the same type on the two stalks.

The invention claimed is:

1. A pair of swimming goggles with two ocular assemblies connected by a bridging element and a means to adjust the separation between the said two ocular assemblies, with the bridging element being composed, symmetrically in relation to a median plane, of a central body and, laterally on either side of the central body, of a lower stalk and an upper stalk which are flexible and attached to an ocular assembly, wherein:

a) each of the two ocular assemblies has at least on a first face, a shoulder acting as the first temporary locking resources, of a one of the upper or lower stalk, and b) this said upper or lower stalk is fitted with ridges or holes, acting as the second temporary locking resources, designed to fit onto the shoulder so that the temporary locking of this said upper or lower stalk on the said first face of the ocular assembly is achieved at a distance from the central body chosen by the user.

2. A pair of goggles according to claim 1, wherein a single stalk, either upper or lower, is fitted with the second temporary locking resources, and wherein an end, opposite to the central body, of the other stalk is fixed definitively on the first face, in particular because of first securing resources mounted on the first face of the ocular assembly and of the second securing resources mounted on the end of the said other stalk.

3. A pair of swimming goggles according to claim 2, wherein the first temporary locking resources of the ocular assembly are formed from a single part.

4. A pair of swimming goggles according to claim 3, composed of up to eight separate parts, namely:

a) the two ocular assemblies, each presenting at least a rear face and being single-block, b) the bridging element, which is a single-block, c) two watertight pressure-parts in a compressible material, mounted on the periphery of said rear faces of the two ocular assemblies, d) two elastic straps, each with one free end in the form of a loop, shaped to be mounted around an ocular assembly between the first temporary locking resources, and e) a buckle for the attachment of the two other free ends of the two elastic straps.

5. A pair of swimming goggles according to claim 4, composed of six separate parts, the two watertight pressure-parts being incorporated into the looped ends of the elastic straps.

6. A pair of swimming goggles according to claim 3, composed of up to eight separate parts, namely:

a) the two ocular assemblies, each presenting at least a rear face and being single-block, b) the bridging element, which is a single-block, c) two watertight pressure-parts in a compressible material, mounted on the periphery of said rear faces of the two ocular assemblies, d) two elastic straps, each with one free end in the form of a loop, shaped to be mounted around an ocular assembly between the first temporary locking resources and the first securing resources and the watertight pressure-part, and e) a buckle for the attachment of the two other free ends of the two elastic straps.

7. A pair of swimming goggles according to claim 2, wherein the first temporary locking resources of the ocular assembly are formed from a single part.

8. A pair of swimming goggles according to claim 2, wherein the shoulder acting as the first temporary locking resources and/or the first securing resources takes the form of a stud in the shape of a mushroom formed on a first face of the ocular assembly, and the second temporary locking resources and/or the second securing resources consist of one or more open holes formed in the end of the upper or lower stalk fitted with the secondary temporary locking resources.

9. A pair of swimming goggles according to claim 2, wherein the first securing resources are formed from a single part.

10. A pair of swimming goggles according to claim 1, wherein the first face is the upper portion and/or the proximal portion of the lateral face of the ocular assembly.

11. A pair of swimming goggles according to claim 1, wherein the shoulder is a longitudinal shoulder drilled with a hole for the passage of the upper or lower stalk fitted with the second temporary locking resources, and wherein the upper or lower stalk has a multiplicity of successive ridges, designed to constitute as many end stops against the outer face of the longitudinal shoulder, and wherein material employed for the ridges is deformable, so that it is possible by applying traction or pressure to the upper or lower stalk, to pass a ridge through the hole created in the shoulder.

12. A pair of swimming goggles according to claim 1, wherein the shoulder acting as the first temporary locking resources and/or the first securing resources takes the form of a stud in the shape of a mushroom formed on a first face of the ocular assembly, and the second temporary locking resources and/or the second securing resources consist of one or more open holes formed in the end of the upper or lower stalk fitted with the secondary temporary locking resources.

13. A pair of swimming goggles according to claim 1, wherein the central body and laterally, the two sets of upper and lower stalks are a single part.

14. A pair of swimming goggles according to claim 1, wherein the central body of the bridging element is made from a flexible elastomer type material that allows deformation.

15. A pair of swimming goggles according to claim 1, wherein first securing resources are formed from a single part.

* * * * *